US005965336A

United States Patent [19]

Martin

[11] Patent Number: 5,965,336

[45] Date of Patent: Oct. 12, 1999

[54] METHOD FOR THE ANTISTATIC PROCESSING OF A PHOTOGRAPHIC FILM

[75] Inventor: Marcel H. Martin, Chalon Sur Saone, France

[73] Assignee: Eastman Kodak Company, Rochester, N.Y.

[21] Appl. No.: 09/175,515

[22] Filed: Oct. 20, 1998

[51] Int. Cl.[6] ..... G03C 5/28

[52] U.S. Cl. ..... 430/422; 430/423; 430/427; 430/432

[58] Field of Search ..... 430/422, 423, 430/427, 432

[56] References Cited

U.S. PATENT DOCUMENTS

| | | | |
|---|---|---|---|
| 2,053,621 | 9/1936 | Mackler | 430/423 |
| 3,811,887 | 5/1974 | Ishihara et al. | 430/427 |

FOREIGN PATENT DOCUMENTS

| | | |
|---|---|---|
| 0 805 377 A1 | 11/1997 | European Pat. Off. . |
| 2 748 131 | 10/1997 | France . |
| 96/13459 | 5/1996 | WIPO . |

OTHER PUBLICATIONS

Research Disclosure, vol. 365, Sep., 1994, Item 36544, IX–C, pp. 520–521.

E.F.French & F.C.H. Hillyer: "Static Electricity: An Introduction to the Problems and Their solutions in the Film and Television Industries" SMPTE Journal, vol. 95, No. 5, May, 1986.

*Primary Examiner*—Hoa Van Le
*Attorney, Agent, or Firm*—Andrew J. Anderson

[57] ABSTRACT

The invention concerns the antistatic processing of photographic products. The process of the invention comprises applying an antistatic composition to the edge of a film reel. The antistatic composition may comprise an aqueous solution of an polymeric aluminosilicate. The invention has application to the improvement of antistatic characteristics during the photographic processing and printing of cinematographic films.

9 Claims, 1 Drawing Sheet

METHOD FOR THE ANTISTATIC PROCESSING OF A PHOTOGRAPHIC FILM

FIELD OF THE INVENTION

The present invention concerns a method for the processing of a silver halide photographic element with a view to obtaining a visible image, this method comprising a step for improving the antistatic properties of the processed element.

BACKGROUND OF THE INVENTION

Typically, a silver halide photographic element, after exposure, is developed, fixed, washed and dried. In the development step, the latent image formed by the exposure of the photosensitive silver halides is converted into a visible image. In the fixing step the undeveloped silver halides are washed out. In the case of an element for color photography, the exposed element is color developed and the processing also comprises a bleaching step in which the developed silver is eliminated, so that the processed element contains no more than a dye image. The bleaching and fixing steps can be combined in a single bleaching/fixing step. In practice, the element to be processed is in the form of a strip of film which, from a feed reel, is transported successively by means of conveying rollers through processing tanks containing respectively developing, bleaching, fixing, stabilizing, stop and washing solutions.

In the case of the printing and photographic processing of motion picture films, it is necessary to circulate at speeds which are sometimes high (several thousands of meters per hour), hundred of meters of film delivered by storage or feed reels or "coils"having a diameter ranging up to 50 cm or more. These large quantities, large-diameter coils and high feed rates give rise to tensions and friction which are themselves responsible for the formation of static electricity. The accumulation of the static charges is responsible for the attraction and accumulation of dust on the surface of the film. This is prejudicial to the quality of the surface state of the film when the latter is subjected to mechanical stresses during reprinting and copying. In addition, when handling the coils, this accumulation of charges can cause an electrical discharge, and produce a spark causing fog on the exposed film, if this incident occurs before development.

This phenomenon of the accumulation of charges, known as electrostatic charging, is well known in photography. A very large number of antistatic substances have been tried for reducing electrostatic charging and its effects. Such substances are described in *Research Disclosure*, September 1994, Photographic Silver Halide Emulsions, Preparations, Addenda, Systems and Processing, IX-C, page 520.

In photography, antistatic substances must obviously help to reduce the electrostatic charges, including in a dry atmosphere. On the other hand, they must not interfere with the other constituents of the photographic material or with the substances acting during photographic processing. Different antistatic agents are known and can be used during the manufacture of a photographic film. However, at the time of development and use of the developed film, protection by the antistatic agents initially incorporated during the manufacturing of the film has become insufficient in the majority of cases and, in particular, in the case of motion picture films.

The object of the present invention is a method for solving these problems by providing improved antistatic protection for a photographic film at the time of its processing.

SUMMARY OF THE INVENTION

In accordance with one embodiment of the invention, a method for processing a photographic element in strip form wound on a feed reel is disclosed, comprising unwinding the element from the feed reel and subjecting the unwound element to an exposure step, a development step or a fixing step, wherein at least one of the edges of the feed reel is brought into contact with an antistatic composition prior to said exposure, development or fixing step.

DETAILED DESCRIPTION OF THE INVENTION

Figure 1:
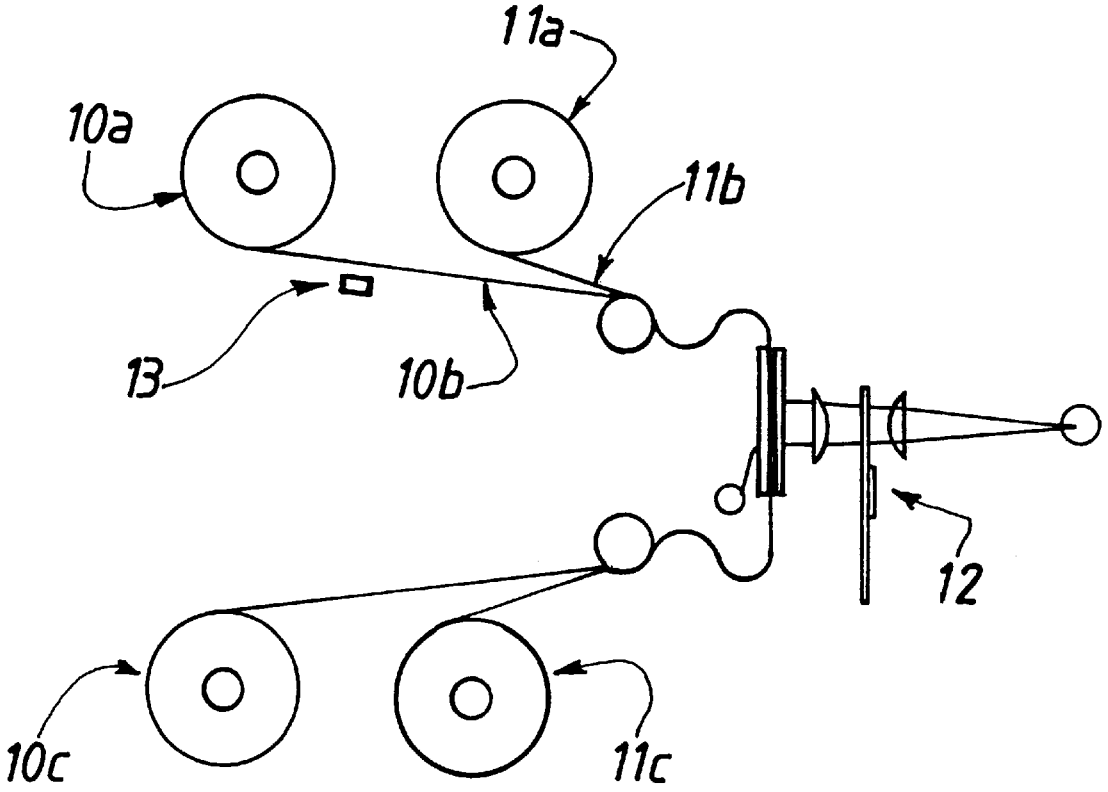
FIG. 1 schematically illustrates a continuous contact cine printer as used in Examples 1–3.

According to one embodiment of the invention, the antistatic composition may comprise an aqueous solution of a polymeric aluminosilicate of formula $Al_xSi_yO_z$, in which x:y is between 1 and 3 and z is between 2 and 6. Such polymeric aluminosilicates are described in European patent application 96936962.1 (Publication No. PCT/EP95/04165), and corresponding U.S. Ser. No. 08/666,516, the disclosures of which are incorporated by reference herein in their entirety.

The polymeric aluminosilicate can be applied in the form of an aqueous composition containing 0.1 to 10 g of Al+Si per liter and preferably 0.5 to 5 g of Al+Si per liter. The composition can be sprayed on one of the faces of the reel, or one face can be contacted with a pad impregnated with this composition. Both faces of the reel can be treated if desired. An additional application of antistatic agent can also be made on the faces of the film after the reel is unwound. This additional application can be carried out at various stages of the processing.

In the case of motion picture films, the polymeric aluminosilicate can be deposited onto faces of the reel of positive (or intermediate) film and the reel of processed negative film, before printing to produce an internegative. Thus, the film will be protected throughout the processing line. As indicated, an additional application of the aqueous polymeric aluminosilicate composition can also be effected after printing or at the end of processing. Several applications, at different stages of the processing, are possible.

The aqueous polymeric aluminosilicate composition can contain usual additives for improving homogeneity, film-forming characteristics, storage, for adjusting viscosity, surfactants, in particular non-ionic surfactants or anti-UV agents. The composition can also be packaged in the form of an aerosol in a spray can.

Preparation of the Aluminosilicate Solution 5 liters of an aqueous solution containing 36.52 g of $AlCl_3,6H_2O$ (99% purity) was mixed with 5 liters of an aqueous solution containing 12.79 g of $Si(OMe)_4$ (98% purity). 370 ml of NaOH 1M were added. The pH is 4.5. The solution had a cloudy appearance. It was left to stand overnight. A solution of NaOH 1M was added until a pH of 6.8 was obtained. A gel was formed and recovered by centrifugation (3200 rev/min). This gel was resolubilised in 5 liters of $H_2O$ with a mixture of HCl 1M/$CH_3CO_2H$ 2M added. This solution was diluted with 11 liters of water and the diluted solution obtained was heated at 96° C. for 5 days in a glass reactor. After cooling, the solution was concentrated by ultrafiltration until 2 g Al+Si/liter was obtained. 2.4% by weight of a surfactant (Surfactant 10G™, p-nonylphenoxypolyglycerol) were added to this solution.

EXAMPLE 1

A black and white negative film was printed on a black and white print film (Eastman Fine Grain Release Positive Film) at a speed of 3600 meters/hour in a Bell & Howell continuous contact cine printer (35 mm, Model C), depicted schematically in FIG. 1. This printer comprises a reel 10*a* supplying the printer with positive film (unexposed) 10*b* and a reel 11*a* supplying the printer with negative film (developed) 11*b*. The two films were exposed in contact in the station 12 and rewound on the reels 10*c* and 11*c*. A sensor 13 was disposed, connected to the field meter on the film 10*b*, at the discharge from the reel 10*a*. The surface electrical field was measured with a Monroe field meter model 245. The sensor of the field meter was disposed at the discharge from the film reel 10*a*, at approximately 5 cm from the initial unwinding point and at approximately 1 cm from the surface of the film. The apparatus being calibrated at 2 $kVcm^{-1}$, a field of 2 $kVcm^{-1}$ was measured. Alternatively, the electrical field can be measured on the positive film after it was contacted with the processed negative film and before it was wound onto reel 10*c*.

EXAMPLE 2

The operating method of Example 1 was repeated, except that, before exposure (printing) and fitting the reel in the printer, the face of the reels of film 10*a* and 11*a* was wetted with a sponge impregnated with a solution of the above polymeric aluminosilicate. The electrical field was then measured as in Example 1. No detectable field was measured. The measurement was repeated, calibrating the apparatus at 0.5 $kVcm^{-1}$: again no field was detected.

EXAMPLE 3

The operating method of Example 2 was repeated, except that, instead of impregnating the face of the roll of film, the solution of polymeric aluminosilicate was sprayed onto this face. After drying, the electrical field was measured as in Example 1. No detectable field, including when calibrating at 0.5 $kVcm^{-1}$ was measured.

The invention has been described in detail with particular reference to certain preferred embodiments thereof, but it will be understood that variations and modifications can be effected within the spirit and scope of the invention.

What is claimed is:

1. A method of processing a photographic element in strip form wound on a feed reel comprising unwinding the element from the feed reel and subjecting the unwound element to an exposure step, a development step or a fixing step, wherein at least one of the edges of the feed reel is brought into contact with an antistatic composition prior to said exposure, development or fixing step.

2. The method of claim 1, wherein the antistatic composition is an aqueous solution of a polymeric aluminosilicate of formula $Al_xSi_yO_z$ in which x:y is between 1 and 3 and z is between 2 and 6.

3. The method of claim 2, wherein the antistatic composition is an aqueous solution containing 0.1 to 10 g of Al+Si per liter, in the form of a polymeric aluminosilicate.

4. The method of claim 1, which also comprises a step in which the photographic element in strip form passes through the antistatic composition.

5. The method of claim 1, wherein the antistatic composition is sprayed onto at least one of the edges of the reel.

6. The method of claim 1, wherein the contact of the photographic element in strip form with the antistatic composition is prior to a printing or exposure step.

7. The method of claim 1, wherein the element is a motion picture film.

8. The method of claim 7, wherein the element is a motion picture print or intermediate film and the feed reel is brought into contact with the antistatic composition prior to exposure of the print or intermediate film in a cine printer.

9. The method of claim 7, wherein the element is a processed motion picture negative or intermediate film and the feed reel is brought into contact with the antistatic composition prior to printing of the processed negative or intermediate film on an unexposed print or intermediate film in a cine printer.

* * * * *